US007763409B2

(12) United States Patent
Hirota

(10) Patent No.: US 7,763,409 B2
(45) Date of Patent: Jul. 27, 2010

(54) BINDER RESIN FOR TONER, METHOD FOR PRODUCTION THEREOF, AND TONER

(75) Inventor: Yoshihito Hirota, Ichihara (JP)

(73) Assignee: Mitsui Chemicals, Inc., Minato-Ku, Tokyo (JP)

( * ) Notice: Subject to any disclaimer, the term of this patent is extended or adjusted under 35 U.S.C. 154(b) by 813 days.

(21) Appl. No.: 11/596,875

(22) PCT Filed: May 18, 2005

(86) PCT No.: PCT/JP2005/009090

§ 371 (c)(1), (2), (4) Date: Nov. 17, 2006

(87) PCT Pub. No.: WO2005/111730

PCT Pub. Date: Nov. 24, 2005

(65) Prior Publication Data

US 2008/0044753 A1 Feb. 21, 2008

(30) Foreign Application Priority Data

May 19, 2004 (JP) ..... 2004-148715

(51) Int. Cl.
*G03G 5/00* (2006.01)

(52) U.S. Cl. ..... 430/137.15; 430/137.18; 430/109.1; 524/492

(58) Field of Classification Search ..... 430/137.15, 430/137.18, 109.1; 524/492
See application file for complete search history.

(56) References Cited

U.S. PATENT DOCUMENTS

| | | | |
|---|---|---|---|
| 3,967,962 | A | 7/1976 | O'Malley |
| 4,940,644 | A | 7/1990 | Matsubara et al. |
| 5,147,747 | A | 9/1992 | Wilson et al. |
| 5,976,752 | A | 11/1999 | Matsunaga et al. |
| 2004/0132920 | A1 | 7/2004 | Matsumura et al. |

FOREIGN PATENT DOCUMENTS

| | | | |
|---|---|---|---|
| CN | 1218203 | A | 6/1999 |
| EP | 1385062 | A1 | 1/2004 |
| JP | 63-027856 | | 2/1988 |
| JP | 03-231757 | | 10/1991 |
| JP | 04-026858 | | 1/1992 |
| JP | 04-081770 | | 3/1992 |
| JP | 07-181726 | | 7/1995 |
| JP | 2001-117268 | | 4/2001 |
| JP | 2001-305796 | | 11/2001 |
| JP | 2002-099113 | | 4/2002 |
| JP | 2002-108018 | | 4/2002 |
| JP | 2003-050476 | | 2/2003 |
| JP | 2003-262978 | | 9/2003 |

*Primary Examiner*—Mark A Chapman
(74) *Attorney, Agent, or Firm*—Buchanan Ingersoll & Rooney PC

(57) ABSTRACT

The present invention relates to a binder resin for a toner which is used in electrophotography and the like. An objective of the present invention is to obtain a binder resin for a toner containing a crystalline resin which satisfies both excellent low temperature fixing property and excellent offset resistance, a method for producing the binder resin, and a toner using the binder resin. The objective can be achieved by using a binder resin for a toner that is produced by subjecting an amorphous resin and a crystalline resin to melting, kneading and reaction, and is characterized in that it includes a network structure which includes a crystalline resin.

3 Claims, 4 Drawing Sheets

BINDER RESIN FOR TONER, METHOD FOR PRODUCTION THEREOF, AND TONER

TECHNICAL FIELD

The present invention relates to a binder resin for a toner used in an electrophotography method, an electrostatic recording method and electrostatic printing method, a method for producing the same, and a toner.

BACKGROUND ART

There is a tradeoff relationship between the fixing property and offset resistance of a toner used in electrophotography and the like. Accordingly, there is an objective of how to combine these two properties in designing a binder resin for a toner. Further, the toner is also required to have a storage stability which refers to a property such that toner particles do not aggregate, that is, do not block in the fixing apparatus.

In response to these demands, there has been known a technique for improving the fixing property at a low temperature by introducing a crystalline component into a binder resin composed of an amorphous resin. Since the crystalline resin is rapidly melted via its melting point to have a low viscosity, it is possible to reduce the viscosity of the resin with low thermal energies and improvement of the fixing property is expected.

As a known technique for introducing a crystalline resin into a binder resin composed of an amorphous resin, there have been proposed (i) a method of hybridization of an amorphous resin and a crystalline resin at the molecular chain level in the form of a block copolymer or a graft copolymer (for example, refer to Patent Document 1), (ii) a method of blending the combination of an amorphous resin and a crystalline resin having good compatibility with each other in a physical kneading method such as melt blending, powder blending or the like (for example, refer to Patent Document 2), (iii) a method of blending the combination of an amorphous resin and a crystalline resin having poor compatibility with each other in a physical kneading method such as melt blending, powder blending or the like (for example, refer to Patent Documents 3 and 4) and the like. In the aforementioned methods (i) and (ii), however, the compatibility between the amorphous portion and the crystalline portion is good, and numerous crystalline polymer chains that cannot crystallize remain in the amorphous portion, so that it is difficult to maintain sufficient storage stability. For that reason, there is required a step of promoting and controlling crystal growth by carrying out heat treatment at a predetermined period of time or the like in some cases (refer to Patent Document 5). Further, in the method (iii), the compatibility between the amorphous portion and the crystalline portion is insufficient so that dispersion of the crystalline resin becomes difficult and it is difficult to secure the stability of the toner properties. Further, there has also been known a method for controlling the compatibility of both components by properly adjusting the monomer composition of a crystalline polyester and an amorphous polyester, and finely dispersing with a dispersion diameter of the crystalline polyester of from 0.1 to 2 μm (for example, refer to Patent Document 6). However, even in that case, since the crystal size and distribution are also varied depending on the cooling conditions at the time of producing the binder resin and producing the toner, there is a problem in securing the stability of the toner properties. In addition, the kind of monomers which can be used and composition thereof are restricted.

Patent Document 1: JP-A-04-26858
Patent Document 2: JP-A-2001-222138
Patent Document 3: JP-A-62-62369
Patent Document 4: JP-A-2003-302791
Patent Document 5: JP-A-01-35456
Patent Document 5: JP-A-2002-287426

DISCLOSURE OF THE INVENTION

An object of the present invention is to provide a binder resin for a toner containing a crystalline resin, the binder resin satisfying both excellent low temperature fixing property and excellent offset resistance.

In order to achieve the above objective, the present inventors have conducted an extensive study and completed the present invention. That is, the present invention relates to a binder resin for a toner comprising a network structure which comprises a crystalline resin.

The present invention further relates to a binder resin for a toner satisfying all of the following requirements (1) to (3):

(1) The heat of crystal melting is not less than 5 J/g and the melting peak temperature is from 60 to 120° C., both being measured by DSC:

(2) The storage modulus (G') at 180° C. is not less than 100 Pa; and (3) In the pulsed NMR measurement using the Carr Purcel Meiboom Gill (CPMG) method, when the initial signal intensity of the free induction decay curve (FID) of $^{1}H$ nucleus to be obtained is defined as 100%, the relative signal intensity at 20 ms is not more than 30% and the relative signal intensity at 80 ms is not more than 20%.

The present invention further relates to a binder resin for a toner consisting of a tetrahydrofuran (THF) soluble portion and a THF-insoluble portion, wherein the entire resin in the bulk state is swollen when the resin in the bulk state is immersed in THF.

The present invention further relates to a method for producing the binder resin for a toner, which comprises a step of subjecting an amorphous resin (X) having the amount of monomer having a functional group of not less than 8 weight % based on the total amount of used monomers and a peak molecular weight of not less than 20,000, an amorphous resin (Y) having the amount of monomer having a functional group of less than 5 weight % based on the total amount of used monomers and a peak molecular weight of less than 10,000, and a crystalline resin (Z) to melting, kneading and reaction.

EFFECT OF THE INVENTION

By using the binder resin for a toner of the present invention, it is possible to provide a toner for electrophotography satisfying both excellent fixing property at a low temperature and excellent offset resistance and having excellent storage stability and stable toner features.

Figure 1:
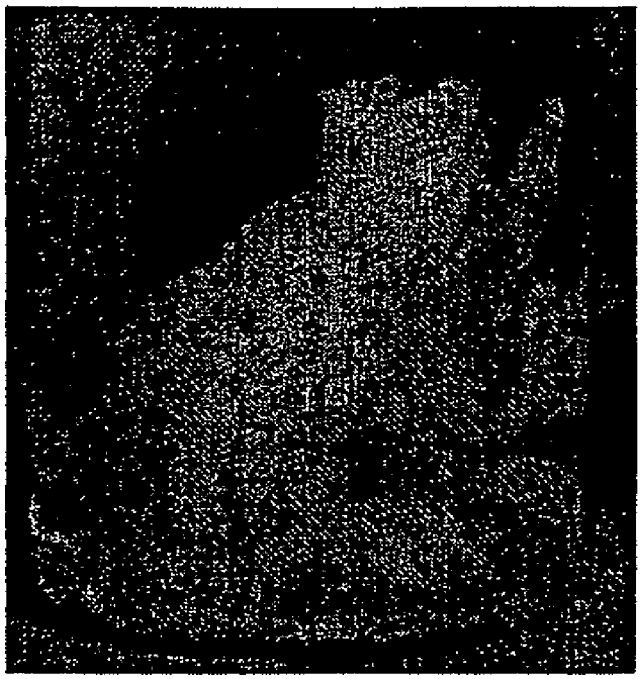
FIG. 1 is a picture illustrating the state of the resin immersed in THF used in Example 1.

REFERENCE NUMBERS IN THE DRAWINGS (1) Unreacted crystalline polyester resin and a reactant of a crystalline polyester resin with a styrene acrylic resin
(2) Unreacted styrene acrylic resin
(3) Lamella of a crystalline polyester resin
(4) Pores in a THF-insoluble portion
(5) Styrene acrylic resin
(6) Crystalline polyester resin

BEST MODE FOR CARRYING OUT THE INVENTION

The binder resin for a toner of the present invention contains a network structure which comprises a crystalline resin. In the present invention, the network structure which comprises a crystalline resin refers to a network structure having an amorphous resin and a crystalline resin as a skeleton component. By having this structure, a feature of the crystalline resin in which the viscosity is rapidly lowered via the melting point can be utilized. Namely, the network structure which comprises a crystalline resin of the present invention has higher thermal responsiveness as compared to the known network structure so that it is possible to lower the viscosity of the entire resin with low thermal energies. Furthermore, decrease in the viscosity of the resin in the melt state can be suppressed. For that reason, it is possible to exhibit better fixing property than a conventional binder resin for a toner while maintaining sufficient offset resistance. The network structure which comprises a crystalline resin of the present invention is uniformly formed in the toner particles in a size sufficiently smaller than that of the toner, whereby stable toner features with less quality difference among toner particles can be exhibited.

Furthermore, the network structure which comprises a crystalline resin has the following features with respect to a known technique for introducing a crystalline resin: (a) a crystalline resin and an amorphous resin are not compatible with each other in the melt state so that both components are not mixed together; (b) a crystalline resin apprehensive of deteriorating the storage stability is distributed in a size of not more than 1 μm in a resin having a high molecular weight or high glass transition temperature (Tg) which is effective in improving the storage stability; and (c) a crystalline resin is not randomly dispersed, but exists as a component constituting a continuous or partially continuous phase. According to the feature in (a), there is a low possibility that a crystalline resin that cannot grow into a crystal remains in an amorphous portion. According to the feature in (b), since an interface between a crystalline resin and an amorphous resin is protected by a resin having a high molecular weight or high Tg which is effective in improving the storage stability, it is possible to maintain sufficient storage stability Further, according to the feature in (b), since a crystalline resin is dispersed in a size of not more than 1 μm, it is possible to secure the stability of the toner feature. In a polymer blend generally composed of a plurality of components, the blend is melted from a solid to a highly viscous melt and to a low viscous melt. Such a feature (melt feature) of the blend, particularly in the highly viscous melt state, dominantly contributes to melt feature inherent in a component constituting a continuous phase. For that reason, according to the merit in (c), the melt feature of the entire resin can be improved and the fixing property can be improved with a small amount of the crystalline resin introduced. In conclusion, since the amount of the crystalline resin introduced is small, sufficient storage stability can be maintained and stability of the toner feature can be secured.

The binder resin for a toner of the present invention, containing the network structure which comprises a crystalline resin, satisfies all of the following three requirements:

(1) The heat of crystal melting is not less than 5 J/g and the melting peak temperature is from 60 to 120° C., both being measured by DSC;

(2) The storage modulus (G') at 180° C. is not less than 100 Pa; and (3) In the pulsed NMR measurement using the Carr Purcel Meiboom Gill (CPMG) method, when the initial signal intensity of the free induction decay curve (FID) of $^{1}H$ nucleus to be obtained is defined as 100%, the relative signal intensity at 20 ms is not more than 30% and the relative signal intensity at 80 ms is not more than 20%.

The requirement (1) indicates that a crystalline resin is contained in a binder resin for a toner. The requirement (2) indicates that a component which suppresses the decrease in the viscosity of the melt resin is present in a binder resin for a toner. Furthermore, the requirement (3) indicates that a crystalline resin contained in a binder resin for a toner is introduced into an amorphous resin in a size sufficiently smaller than that of toner particle, and a polymer chain of a crystalline resin cannot freely move in a binder resin in the melt state due to an interaction with a polymer chain of an amorphous resin. By satisfying the above three requirements, (A) a crystalline resin is introduced into an amorphous resin at sufficiently small scale and in a state that it can be crystallized; (B) a crystalline resin cannot freely move because an amorphous resin is in the way, even when a binder resin is in the melt state; and (C) a component which suppresses the decrease in the viscosity of the melt resin is present in a binder resin. That is, among characteristics of the network structure which comprises a crystalline resin, (b) "a crystalline resin apprehensive of deteriorating the storage stability is distributed in a size of not more than 1 μm in a resin having a high molecular weight or high Tg which is effective in improving the storage stability" is exhibited from (A), (B) and physical properties of a resin to be a raw material, and (c) "a crystalline resin is not randomly dispersed, but exists as a component constituting a continuous or partially continuous phase" is exhibited from (A), (B) and physical properties of a resin to be a raw material. Further, (a) "a crystalline resin and an amorphous resin are not compatible with each other in the melt state so that both components are not mixed together" is exhibited from physical properties of the resin to be a raw material.

The above requirement (1) is evaluated by using differential scanning calorimetry (DSC). The measurement method is as follows. The temperature is raised from 20 to 170° C. at a rate of 10° C./min, and then lowered to 0° C. at a rate of 10° C./min, and again raised to 170° C. at a rate of 10° C./min. The heat of crystal melting measured at the time of second raising is from 1 to 50 J/g, preferably 5 to 40 J/g, and further preferably from 10 to 30 J/g, and the melting peak temperature is from 50 to 130° C., preferably from 60 to 120° C., and further preferably from 70 to 110° C. When the heat of crystal melting is less than 1 J/g, no effect of improvement of fixing property is found. When it is not less than 50 J/g, the toner properties become unstable. Further, when the melting peak temperature is less than 50° C., the storage stability is adversely affected. When it is not less than 130° C., no effect of improvement of fixing property is found.

The requirement (2) in the present invention is evaluated by using a rheometer. The viscoelasticity is measured under the conditions of 1 mm of gap length, 1 Hz of frequency at 50 to 200° C. at a rate of 2° C./min. In the measurement, the elastic modulus (G') at 180° C. is from 50 to 10,000 Pa, preferably from 100 to 3,000 Pa and further preferably from 300 to 2,000 Pa. When G' is less than 50 Pa, sufficient offset resistance is not obtained, while when it is not less than 10,000 Pa, the fixing property is worsened.

The requirement (3) in the present invention is evaluated by using a pulsed NMR. The pulsed NMR is an analysis generally used as a method for evaluating a mobility of a polymer chain or a state of the interaction between different components, and is evaluated by measuring $^1$H transverse relaxation time of all components constituting a resin. The lower the mobility of a polymer chain, the shorter its relaxation time, and consequently the faster the attenuation of the signal intensity, and the relative signal intensity is lowered within a short period of time when the initial signal intensity is 100%. Meanwhile, the higher the mobility of a polymer chain, the longer its relaxation time, and consequently the slower the attenuation of the signal intensity, and the relative signal intensity is slowly lowered over a long period of time when the initial signal intensity is defined as 100%. In the pulsed NMR measurement carried out at 160° C., 2.0 μsec of the observation pulse width and 4 sec of the repeating time according to the Carr Purcel Meiboom Gill (CPMG) method, when the initial signal intensity of the free induction decay curve (FID) of $^1$H nucleus to be obtained is defined as 100%, the relative signal intensity at 20 ms is from 3 to 40%, preferably from 3 to 30% and further preferably from 3 to 20%, and the relative signal intensity at 80 ms is from 0.5 to 30%, preferably from 0.5 to 20% and further preferably from 0.5 to 10%. When the relative signal intensity at 20 ms is less than 3% and the relative signal intensity at 80 ms is less than 0.5%, no effect of improving the fixing property is found. When the relative signal intensity at 20 ms is not less than 40% and the relative signal intensity at 80 ms is not less than 30%, the toner properties become unstable.

The network structure which comprises a crystalline resin of the present invention is separated from the binder resin as an insoluble portion, for example, by carrying out an extraction test using a solvent such as tetrahydrofuran (THF) or the like. The content of the THF-insoluble portion is from 10 to 90 weight % and preferably from 15 to 85 weight % in the binder resin. By having the content of THF-insoluble portion within the above range, good offset resistance is achieved.

Figure 2:
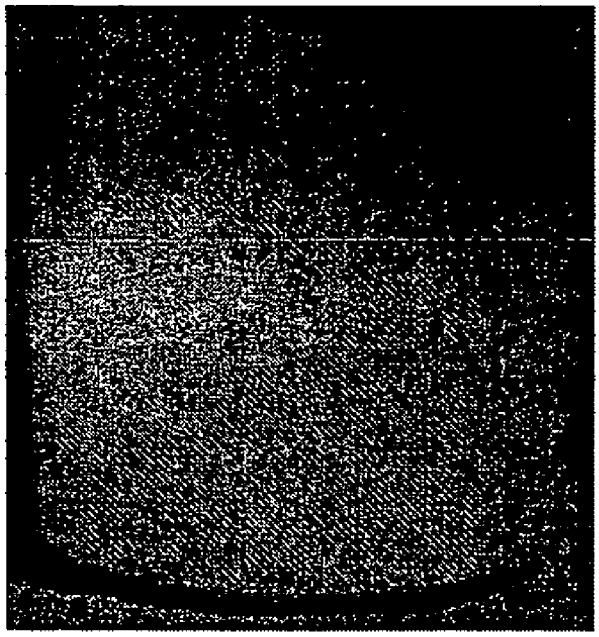
FIG. 2 is a picture illustrating the state of the resin immersed in THF used in Comparative Example 4.

To carry out the THF extraction test, the resin solid content is immersed in THF, and then immersed in ethanol and dried. The THF-insoluble portion is observed as shown in FIG. 1 in which the entire resin is swollen generally without collapsing its shape at a state that it is immersed in THF. Further, the resin solid content may be those obtained by melting a powder resin to make it in the bulk state. This phenomenon is peculiar to the binder resin for a toner of the present invention, and cannot be observed in a resin obtained by dispersing a crystalline resin randomly in an amorphous resin as shown in FIG. 2.

The THF-insoluble portion is generally observed as a porous structure having an average pore diameter of from 0.05 to 2 μm and preferably from 0.1 to 1 μm by scanning electron microscope (SEM), while the heat of crystal melting of the THF-insoluble portion is not less than 1.2 times, preferably not less than 1.5 times and further preferably not less than 2 times based on the heat of crystal melting of the entire resin. When the average pore diameter is less than 0.05 μm, the storage stability is adversely affected. When it is not less than 2 μm, the toner properties become unstable. Further, even when the heat of crystal melting of the THF-insoluble portion is less than 1.2 times based on the heat of crystal melting of the entire resin, the toner properties become unstable. The THF-insoluble portion has a porous structure and the heat of crystal melting of the THF-insoluble portion is not less than 1.5 times based on the heat of crystal melting of the entire resin, whereby a characteristic of the network structure which comprises a crystalline resin, (c) "a crystalline resin is not randomly dispersed, but exists as a component constituting a continuous or partially continuous phase," can be more surely confirmed.

The network structure of the present invention can be directly observed without being extracted by THF, for example, by carrying out the observation with a scanning probe microscope (SPM). SPM is a measurement device capable of detecting physical information such as the viscoelasticity or the like at nano-scale resolution and is capable of imaging by contrasting the network component with other components.

The amorphous resin contained in the binder resin for a toner of the present invention is a styrene acrylic resin, a polyester resin, a polyester polyamide resin, a hybrid resin in combination thereof or the like and is not particularly restricted thereto, but preferred are those soluble in THF (THF-soluble portion).

Of these resins, the styrene acrylic resin has a very low water absorption so that it is excellent in environmental stability. Such a resin can be particularly preferably used in the present invention. The glass transition temperature of the styrene acrylic resin is preferably from 10 to 120° C. When the glass transition temperature is less than 10° C., sufficient storage stability might not be achieved in some cases. When it is more than 140° C., sufficient low temperature fixing property might not be achieved in some cases. Further, the peak molecular weight of the styrene acrylic resin is preferably from 1,000 to 500,000 and more preferably from 3,000 to 100,000. When the peak molecular weight is less than 1,000, sufficient resin strength might not be achieved in some cases. When it is more than 500,000, sufficient fixing property at a low temperature might not be exhibited in some cases.

In the present invention, the styrene acrylic resin represents a copolymer of a styrenic monomer and an acrylic monomer. The styrenic monomers and acrylic monomers used for the styrene acrylic resin are not particularly limited. Preferable examples thereof include styrenic monomers such as styrene, α-methylstyrene, p-methoxystyrene, p-hydroxystyrene, p-acetoxystyrene and the like; alkyl(meth)acrylate having 0 to 18 carbon atoms of the alkyl group such as (meth)acrylic acid, methyl(meth)acrylate, ethyl(meth)acrylate, butyl(meth) acrylate, 2-ethylhexyl(meth)acrylate, lauryl(meth)acylate, stearyl(meth)acrylate and the like; hydroxyl group-containing (meth)acrylate such as hydroxyethyl(meth)acrylate and the like; amino group-containing (meth)acrylate such as dimethylaminoethyl(meth)acrylate, diethylaminoethyl(meth) acrylate and the like; and glycidyl group-containing (meth) acrylate such as glycidyl(meth)acrylate, β-methyl glycidyl (meth)acrylate and the like. In addition thereto, as monomers capable of copolymerizing with the above-mentioned monomers, nitrile monomers such as acrylonitrile, methacrylonitrile and the like; vinyl esters such as vinyl acetate and the like; vinyl ethers such as vinyl ethyl ether and the like; and unsaturated carboxylic acids such as monoesters of maleic acid, itaconic acid and maleic acid, or anhydrides thereof may be used.

Of these, preferably used are styrenic monomers, alkyl (meth)acrylate having 0 to 18 carbon atoms of the alkyl group and unsaturated carboxylic acids. More preferably used are styrene, methyl(meth)acrylate, ethyl(meth)acrylate, butyl (meth)acrylate, 2-ethylhexyl(meth)acrylate, lauryl(meth) acrylate and (meth)acrylic acid.

As a method for polymerization of the styrene acrylic resin, any of solution polymerization, bulk polymerization, suspension polymerization, emulsion polymerization, combination of bulk polymerization and solution polymerization and the like can be selected. Of these polymerization methods, solution polymerization is preferable. In the solution polymerization, resins with many functional groups introduced thereinto or resins having relatively small molecular weights are easily obtained.

The crystalline resin contained in the binder resin for a toner of the present invention is a polyester resin, a polyolefin resin, a hybrid resin in combination thereof or the like and is not particularly restricted thereto, but preferred are those insoluble in THF (THF-insoluble portion).

Of these resins, the polyester resin can be particularly preferably used in the present invention since it is easy to control the melting point. The melting peak temperature of the crystalline polyester resin is preferably from 50 to 170° C. and more preferably from 80 to 110° C. When the melting peak temperature is less than 50° C., sufficient storage stability might not be achieved in some cases. When it is more than 170° C., sufficient low temperature fixing property might not be exhibited in some cases. Further, the peak molecular weight of the crystalline polyester resin is preferably from 1,000 to 100,000. When the peak molecular weight is less than 1,000, sufficient storage stability might not be achieved in some cases. When it is more than 100,000, the productivity might be lowered along with deterioration of the degree of crystallinity in some cases.

The crystalline polyester resin is preferably a resin obtained by polycondensation of an aliphatic diol with an aliphatic dicarboxylic acid. The number of carbon atoms of the aliphatic diol is preferably from 2 to 6 and more preferably from 4 to 6. The number of carbon atoms of the aliphatic dicarboxylic acid is preferably from 2 to 22 and more preferably from 6 to 20.

Preferable examples of the aliphatic diol having 2 to 6 carbon atoms include 1,4-butanediol, ethylene glycol, 1,2-propylene glycol, 1,3-propylene glycol, 1,6-hexanediol, neopentyl glycol, 1,4-butenediol, 1,5-pentanediol and the like.

Examples of the aliphatic dicarboxylic acid having 2 to 22 carbon atoms include unsaturated aliphatic dicarboxylic acids such as maleic acid, fumaric acid, citraconic acid, itaconic acid, glutaconic acid and the like; saturated aliphatic dicarboxylic acids such as oxalic acid, malonic acid, succinic acid, adipic acid, decanediol acid, undecanediol acid, dodecane dicarboxylic acid, hexadecanedionic acid, octadecanedionic acid, eicosanedionic acid and the like; acid anhydrides thereof and alkyl (1 to 3 carbon atoms) esters thereof and the like.

The crystalline polyester resin can be obtained, for example, by the reaction of an alcohol and a carboxylic acid in an inert gas atmosphere or the like preferably at a temperature of from 120 to 230° C. In this reaction, as needed, an esterification catalyst or a polymerization inhibitor, known in the art, may be used. Further, the reaction system is subjected to a reduced pressure in the latter half of the polymerization reaction, whereby the reaction may be accelerated.

The network structure of the present invention can be obtained, for example, by reacting a crystalline resin and an amorphous resin while subjecting both components to melting and kneading. The combination of the crystalline resin and the amorphous resin is not particularly limited, but the crystalline resin and the amorphous resin are preferably incompatible with each other.

Examples of the functional group of the crystalline resin include a hydroxyl group, a carboxyl group, an epoxy group, an amino group, an isocyanate group and the like. Further, the functional group of the amorphous resin may have the reactivity with the functional group of the crystalline resin, and examples thereof include a carboxyl group, a hydroxyl group, an ester group, an epoxy group, an amino group, an isocyanate group and the like. Of these, particularly preferred is a dehydrative condensation reaction of a crystalline resin (Z) having a hydroxyl group at the end and the amorphous resin having a carboxyl group.

Further, the amorphous resin is preferably composed of a plurality of components different in the molecular weight and compositions of the monomer having a functional group. Of the components constituting the amorphous resin, one component is an amorphous resin (X) in which the peak molecular weight is not less than 10,000 and the monomer having a functional group is not less than 5% of the total monomers, preferably the peak molecular weight is not less than 20,000 and the monomer having a functional group is not less than 8% of the total monomers, and more preferably the peak molecular weight is not less than 30,000 and the monomer having a functional group is not less than 10% of the total monomers. Meanwhile, another component is an amorphous resin (Y) in which the peak molecular weight is less than 12,000 and the monomer having a functional group is not more than 8% of the total monomers, preferably the peak molecular weight is not more than 10,000 and the monomer having a functional group is not more than 5% of the total monomers, and more preferably the peak molecular weight is not more than 8,000 and the monomer having a functional group is not more than 3% of the total monomers.

Meanwhile, in order to promote the reaction, a low molecular weight compound, an oligomer, a polymer or the like having a number of the functional groups may also be added as a reaction accelerator. The binder resin for a toner of the present invention is preferably produced by heating and kneading the amorphous resin (X), amorphous resin (Y) and crystalline resin (Z) in a mixed state. The crystalline resin (Z) is mainly reacted with the amorphous resin (X) depending on the difference in the content of monomer having a functional group. Due to this difference in the reactivity, the phase separation between amorphous resin components is induced so that the amorphous resin (X) and the crystalline resin (Z) are separated with respect to the amorphous resin (Y), and the network structure which comprises a crystalline resin can be finally formed. Further, since the interface of the crystalline resin becomes stabilized with the process of the reaction, its dispersion diameter is reduced and finally the crystalline resin can be dispersed in a size sufficiently smaller than the diameter of the toner particle.

In order to produce the binder resin for a toner of the present invention, there is no need to control the compatibility between the crystalline resin and the amorphous resin with good accuracy so that a wide range of resin selectivity and monomer selectivity can be realized.

When the binder resin for a toner of the present invention is formed by the reaction of the crystalline resin with the amorphous resin, its reaction conditions are different depending on the combination of the functional groups to react. For example, when the crystalline polyester resin having a hydroxyl group at the end and the styrene acrylic resin having a carboxyl group are reacted, the binder resin for a toner is formed by subjecting both components to melting and kneading at a temperature of from 150 to 250° C. for 1 to 50 hours.

In the reaction of the crystalline resin and the amorphous resin, it is preferable that both components are dissolved and uniformly dispersed by using a solvent, followed by the removal of the solvent to initiate the reaction. By using a solvent before the reaction, the reaction can be uniformly progressed. The solvent used herein is not particularly limited and preferable examples thereof include xylene, ethyl acetate, dimethylformamide, chloroform and THF.

The weight ratio of the crystalline resin to the amorphous resin (the crystalline resin/the amorphous resin) is preferably from 1/99 to 50/50 and more preferably from 5/95 to 30/70. When the weight ratio is less than 1/99, the fixing property at a low temperature might be insufficient in some cases. When it is more than 50/50, the toner properties become unstable.

The state of the crystalline resin dispersed in the binder resin for a toner of the present invention can be observed by using a transmission electron microscope or a scanning probe microscope.

The binder resin for a toner of the present invention can be made into a toner for electrophotography according to a known method along with a coloring agent and, as needed, a charge controlling agent, a wax or a pigment dispersing agent.

Examples of the coloring agent include black pigments such as carbon black, acetylene black, lamp black, magnetite and the like; and known organic and inorganic pigments such as chrome yellow, yellow iron oxide, Hansa yellow G, quinoline yellow lake, permanent yellow NCG, cisazo yellow, molybdenum orange, Balkan orange, Indanthrene, brilliant orange GK, colcothar, quinacridone, brilliant carmin 6B, alizarin lake, methyl violet lake, fast violet B, cobalt blue, alkali blue lake, phthalocyanin blue, fast sky blue, pigment green B, malachite green lake, titanium oxide, zinc flowers and the like. The amount thereof is usually from 5 to 250 weight parts, based on 100 weight parts of the binder resin for a toner of the present invention.

Furthermore, some additives may be incorporated into the binder resin as a wax in the ranges in which the effect of the present invention is not impaired, as needed. Examples of the additives include polyvinyl acetate, polyolefin, polyester, polyvinylbutyral, polyurethane, polyamide, rosin, modified rosin, terpene resin, phenol resin, aliphatic hydrocarbon resin, aromatic petroleum resin, paraffin wax, polyolefin wax, fatty acid amide wax, vinyl chloride resin, styrene-butadiene resin, chroman-indene resin, melamine resin and the like.

Further, a known charge controlling agent such as nigrosine, quaternary ammonium salt or metal-containing azo dye can be suitably selected and used. The amount thereof is preferably from 0.1 to 10 weight parts, based on 100 weight parts of the binder resin for a toner of the present invention.

Any conventional methods can be employed for manufacturing a toner for electrophotography of the present invention. For example, a toner for electrophotography can be obtained by premixing the binder resin for a toner of the present invention, the coloring agent, the charge controlling agent, the wax and the like, kneading the mixture in the melt state by the heat using a twin screw kneader, cooling, and then, finely grinding using a grinder, and classifying using an air classifier to gather the particles usually in the range of 8 to 20 μm. In this case, the resin temperature at the discharge portion of the twin screw kneader is preferably less than 165° C., and the residence time is preferably less than 180 seconds. The content of the binder resin for a toner in the toner for electrophotography obtained by the above method can be adjusted depending on the intended object. The content is preferably not less than 50 weight % and more preferably not less than 60 weight %. The upper limit of the content is preferably 99 weight %.

EXAMPLES

Melting Peak Temperature, Heat Value and Glass Transition Temperature

The crystal melting peak temperature, heat of crystal melting and glass transition temperature of a toner or a binder resin and THF-insoluble portion thereof were obtained by using a differential scanning calorimeter (TA Instruments, DSC-Q1000) The sample was heated from 20 to 170° C. at a rate of 10° C./min and then cooled down to 0° C. at a rate of 10° C./min, and again heated up to 170° C. at a rate of 10° C./min. In the course thereof, at the time of second heating, the melting peak temperature and the glass transition temperature were calculated in accordance with JIS K7121, "Testing methods for Transition Temperatures of Plastics." The extrapolated glass transition initiation temperature was recorded as a measured value for the glass transition temperature. Further, at the time of second heating, the heat value of the crystal melting heat was calculated from the endothermic peak area in accordance with JIS K7122, "Testing Methods for Heat of Transition of Plastics."

(Measurement of Viscoelasticity)

The viscoelasticity of a toner and a binder resin was measured using a rheometer (Reologica Instruments AB, STRESS TECH) under the following conditions.

Measurement mode: Oscillation Strain Control
Gap length: 1 mm
Frequency: 1 Hz
Plate: Parallel plate
Measurement temperature: from 50 to 200° C.
Temperature elevation rate: 2° C./min On a measurement stage at 150° C., a powder resin sample was melted and the melt was shaped into a parallel plate having a thickness of 1 mm, and then the plate was cooled down to 50° C. to initiate measurement of the viscoelasticity. According to the above measurement, the storage modulus (G') at 180° C. was obtained.

(Measurement of Pulsed NMR)

The pulsed NMR measurement on a toner and a binder resin were carried out by using a solid-state NMR measuring device (JEOL Ltd., HNM-MU25) under the following conditions.

Sample type: Powder
Measurement method: Carr Purcel Meiboom Gill (CPMG) method
Observation nucleus: $^{1}H$
Measurement temperature: 160° C.
Observation pulse width: 2.0 μsec
Repeating time: 4 sec
Number of transient: 8 times The initial signal intensity of the free induction decay curve (FID) of $^{1}H$ nucleus to be obtained was defined as 100% and the relative signal intensities at 20 ms and at 80 ms were obtained.

(Morphological Observation)

SEM observation of the THF-insoluble portion of a toner and a binder resin was carried out at an arbitrary magnification using a scanning electron microscope (Hitachi Ltd., S-800). Further, TEM observation of a toner and a binder resin was carried out at an arbitrary magnification using a transmission electron microscope (Hitachi Ltd., H-7000). A measurement specimen of the TEM observation was obtained by preparing ultra thin film pieces using an ultra microtome under cooling and dyeing the pieces with ruthenium, and provided for the measurement. In this dyeing method, a crystalline polyester was not dyed and thus observed as white. Among domain sizes observed as white, the largest diameter (the longest diameter in case of an oval) was measured and defined as a crystal size. Further, when a domain of not less than 0.5 μm was not observed, the crystal size was regarded as less than 0.5 μm.

(Measurement of Molecular Weight)

The molecular weight distribution of a toner and a binder resin was measured by using gel permeation chromatography (JASCO, TWINCLE HPLC) under the following conditions.

Detector: RI detector (SHODEX, SE-31)

Column: GPCA-80M×2 and KF-802×1 (SHODEX)

Mobile phase: Tetrahydrofuran

Flow rate: 1.2 ml/min

The peak molecular weight of the resin sample was calculated by using the calibration curve prepared with monodispersed standard polystyrene.

(Measurement of Softening Point)

The softening point of a binder resin was measured by using a full-automatic dropping device (Mettler Co., Ltd., FP5/FP53) under the following conditions.

Dropping hole diameter: 6.35 mm

Temperature elevation rate: 1° C./min

Initial temperature for heating: 100° C.

A sample in the melt state taken out of the reactor was added while paying attention to entrainment of air into the sample holder and cooled down to room temperature, and then set in a measuring cartridge.

(Production Example of Crystalline Resin)

Raw material monomers shown in Table 1 were fed into a 1-liter, 4-necked flask equipped with a nitrogen inlet tube, a dewatering conduit and a stirrer, and the materials were reacted at 150° C. for 1 hour. Then, 0.16 weight % of titanium lactate (Matsumoto Chemical Industry Co., Ltd, TC-310) based on the total weight of monomers was added thereto, and the mixture was slowly heated up to 200° C. and reacted over 5 to 10 hours. The mixture was further reacted under a reduced pressure of not more than 8.0 kPa, and the acid value became not more than 2 to complete the reaction. The obtained crystalline resins were defined as raw resins a and b.

TABLE 1

| | Raw resin a | Raw resin b |
|---|---|---|
| Diol (g) | 1,4-butanediol 115 | 1,4-hexanediol 115 |
| Dicarboxylic acid (g) | Octadecanedionic acid 385 | Sebacic acid 500 |
| Melting peak temperature (° C.) | 88 | 67 |

(Production Example of Amorphous Resin)

To a 2-liter, 4-necked flask equipped with a nitrogen inlet tube, a dewatering conduit and a stirrer was added 500 g of xylene, which was heated to its reflux temperature (about 138° C.). Raw material monomers shown in Table 2 and a reaction initiator were added dropwise to the reaction flask over 5 hours, followed by further reaction for 1 hour. The resultant mixture was then cooled down to 98° C. and 2.5 g of t-butylperoxyoctoate was added thereto, followed by reaction for 2 hours. The obtained polymer solution was heated up to 195° C. and the solvent was removed under a reduced pressure of not more than 8.0 kPa for 1 hour. The obtained resins were defined as raw resins c to f.

TABLE 2

| | Raw resin c | Raw resin d | Raw resin e | Raw resin f |
|---|---|---|---|---|
| Styrene (g) | 438 | 420 | 393 | 350 |
| Butyl acrylate (g) | 52 | 60 | 57 | 50 |
| Methacrylic acid (g) | 10 | 20 | 50 | 100 |
| di-t-butylperoxide (g) | 50 | 50 | 2 | 20 |
| Glass transition temperature (° C.) | 60 | 63 | 93.4 | 94.5 |
| Peak molecular weight | 5,000 | 5,000 | 47,000 | 7,900 |

(Kneading Reaction)

To a 2-liter, 4-necked flask equipped with a nitrogen inlet tube and a stirrer were added raw resins of the compositions shown in Table 3, 200 ml of ethyl acetate and 5 ml of dimethylformamide. The materials were stirred at about 80° C. and homogeneously dissolved and dispersed. Subsequently, the resultant was heated up to 190° C. and the solvent was removed under a reduced pressure of not more than 8.0 kPa for 1 hour. At such a temperature, kneading reaction was carried out until the softening point became not less than 150° C. The obtained resins were defined as resins A to D.

TABLE 3

| | | Resin A | Resin B | Resin C | Resin D |
|---|---|---|---|---|---|
| Crystalline resin | Raw resin a (g) | 250 | 250 | 150 | |
| | Raw resin b (g) | | | | 250 |
| Amorphous resin | Raw resin c (g) | | 450 | | |
| | Raw resin d (g) | 450 | | 500 | 450 |
| | Raw resin e (g) | 200 | 200 | 250 | 200 |
| | Raw resin f (g) | 100 | 100 | 100 | 100 |
| Softening point (° C.) | | 175 | 153 | 160 | 168 |

(Separation of THF-Insoluble Portion)

1.5 g of the resin or the binder resin was allowed to stand at room temperature for 18 hours in 30 ml of THF and immersed therein to discard a supernatant. The operation, in which 30 ml of THF was further added thereto and, after 3 hours, the supernatant was discarded, was repeated two times. Then, 30 ml of ethanol was added thereto and the resulting mixture was allowed to stand at room temperature for 18 hours for immersion to discard the supernatant, whereby solvent substitution was carried out. The operation, in which 30 ml of ethanol was further added thereto and, after 3 hours, the supernatant was discarded, was repeated two times. Lastly, by vacuum drying the resultant under the conditions of not more than 8.0 kPa, 30° C. for 18 hours, the THF-insoluble portion was obtained. The obtained THF-insoluble portion was provided for DSC analysis and SEM observation. Incidentally, the resin solid content obtained by grinding the resin once and again melting the ground resin to make it in the bulk state may be used.

Examples 1 to 4

6 parts of carbon black (Cabot Corporation, REGAL 330r) and 1 part of a charge controlling agent (Orient Chemical Industries, Ltd., BONTRON S34) were fully mixed with Resins A to D as shown in Table 3 respectively using a Henschel mixer, and then the materials were melt-kneaded at 110° C. for 60 seconds of the residence time using a twin screw extruder (Ikegai Corporation, PCM-30 type), then cooled and coarsely grinding. The coarsely ground resin was finely ground using a jet mill, followed by classification, to obtain a powder having a volume average particle diameter of 8.5 μm. To 100 weight parts of the obtained powder was added 0.5 weight parts of an external additive (Nippon Aerosil Co., Ltd., Aerosil r972) and mixed using a Henschel mixer to obtain a toner for electrophotography. The toners for electrophotography prepared from Resins A to D were defined as Examples 1 to 4 respectively. The general characteristics of Examples 1 to 4 are shown in Table 5.

Comparative Example 1

In the compositions of Resin A (Example 1), a toner was prepared in the same manner as in Example 1 by carrying out powder blending without providing to the kneading reaction, and was defined as Comparative Example 1.

Comparative Example 2

A styrene acrylic resin was prepared in accordance with the following method and used for Comparative Example 2.

0.6 parts of di-t-butylperoxide per 100 parts of styrene was uniformly dissolved in a solution containing 57.4 parts of styrene, 11.9 parts of n-butyl acrylate, 0.7 parts of methacrylic acid and 30 parts of xylene. The resulting solution was continuously fed at a rate of 750 cc/h to a 5 liter reactor kept at 190° C. of an internal temperature, at 0.59 MPa of an internal pressure, to obtain a low molecular weight polymerization solution.

75 parts of styrene, 23.5 parts of n-butyl acrylate and 1.5 parts of methacrylic acid were introduced into another flask purged with nitrogen. The internal temperature was heated to 120° C. and bulk polymerization was carried out at the same temperature for 10 hours. Subsequently, 50 parts of xylene was added, 0.1 parts of di-t-butylperoxide and 50 parts of xylene which were mixed and dissolved in advance were continuously added over 8 hours while keeping at 130° C., and continued to be polymerized for further 2 hours to obtain a high molecular weight polymerization solution.

Next, 100 parts of the low molecular weight polymerization solution and 100 parts of the high molecular weight polymerization solution were mixed together, and flushed in a 1.33-kPa vessel at 160° C. to remove the solvent.

Using the aforementioned resin, a toner was prepared in the same manner as in Example 1.

Comparative Example 3

A styrene acrylic resin subjected to a crosslinking reaction was prepared in accordance with the following method and used for Comparative Example 3.

75 parts of xylene was introduced into a flask purged with nitrogen and was heated up to the xylene reflux temperature (about 138° C.). 65 parts of styrene, 30 parts of n-butyl acrylate, 5 parts of glycidyl methacrylate and 1 part of di-t-butylperoxide were mixed and dissolved in advance. The mixture was continuously added dropwise into the flask over 5 hours and continued to be reacted for further 1 hour. Then, the internal temperature was kept at 130° C. and the reaction was carried out for 2 hours, whereby the polymerization was completed. The solvent was removed by flushing in a 1.33-kPa vessel at 160° C. to obtain a glycidyl group-containing vinyl resin.

100 parts of the low molecular weight polymerization solution and 60 parts of the high molecular weight polymerization solution obtained in Comparative Example 2 were mixed together, and flushed in a 1.33-kPa vessel at 160° C. to remove the solvent. 97 parts of the above resin mixture and 3 parts of the glycidyl group-containing vinyl resin were mixed by using a Henschel mixer. The mixture was kneaded to react by using a twin screw kneader (Kurimoto, Ltd., KEXN S-40 type) at 170° C. for 90.

Using the aforementioned resin, a toner was prepared in the same manner as in Example 1.

Comparative Example 4

A toner binder resin obtained by melt-blending an amorphous polyester and a crystalline polyester was prepared in accordance with the following method and used for Comparative Example 4.

1013 g of 1,4-butanediol, 143 g of 1,6-hexanediol, 1450 g of fumaric acid and 2 g of hydroquinone were introduced into a 5-liter, 4-necked flask equipped with a nitrogen inlet tube, a dewatering conduit and a stirrer. The materials were reacted at 160° C. for 5 hours, and then raised to 200° C., reacted for 1 hour and further reacted at 8.3 kPa for 1 hour to obtain a crystalline polyester.

Raw material monomers shown in Table 4 and 4 g of dibutyl tin oxide were fed into a 5-liter, 4-necked flask equipped with a nitrogen inlet tube, a dewatering conduit, a stirrer and a thermocouple, and were reacted at 220° C. over 8 hours. The reaction was further carried out at 8.3 kPa for about 1 hour to obtain an amorphous polyester.

20 parts of the crystalline polyester, 60 parts of the amorphous polyester A and 20 parts of the amorphous polyester B were blended to prepare a toner in the same manner as in Example 1.

TABLE 4

| | Amorphous polyester A | Amorphous polyester B |
|---|---|---|
| BPA-PO (g) | 2,000 | |
| BPA-BO (g) | 800 | |
| Ethylene glycol (g) | | 400 |
| Neopentyl glycol (g) | | 1,200 |
| Terephthalic acid (g) | 600 | 1,900 |
| Anhydrous dodecenylsuccinic acid | 500 | |
| Anhydrous trimellitic acid (g) | | 700 |

(Note: BPA-PO: Propylene oxide adducts of bisphenol A (average number of moles added: 2.2 moles), BPA-BO: Ethylene oxide adducts of bishpenol A (average number of moles added: 2.2 moles)

Comparative Example 5

A toner binder resin obtained by subjecting an amorphous resin and a crystalline resin to a graft reaction was prepared in accordance with the following method and used for Comparative Example 5.

To a 1-liter separable flask equipped with a nitrogen inlet tube, a dewatering conduit and a stirrer were added 100 g of toluene, 15 g of styrene, 5 g of n-butyl acrylate and 0.04 g of benzoyl peroxide. The materials were reacted at 80° C. for 15 hours, and then cooled down to 40° C. 85 g of styrene, 10 g of n-butyl methacrylate, 5 g of acrylic acid and 4 g of benzoyl peroxide were added thereto. The resulting mixture was again raised to 80° C. and reacted for 8 hours. The obtained polymerization solution was raised to 195° C. for removing the solvent under a reduced pressure of not more than 8.0 kPa for 1 hour to obtain an amorphous resin.

15 parts of the raw resin b and 85 parts of the above amorphous resin, 0.05 parts of p-toluene sulfonic acid and 100 parts of xylene were introduced into a 3-liter separable flask. The materials were refluxed at 150° C. for 1 hour and then xylene was removed by using an aspirator and a vacuum pump to obtain a graft copolymer.

Using the aforementioned resin, a toner was prepared in the same manner as in Example 1.

(Electron Microscopic Observation)

Figure 3:
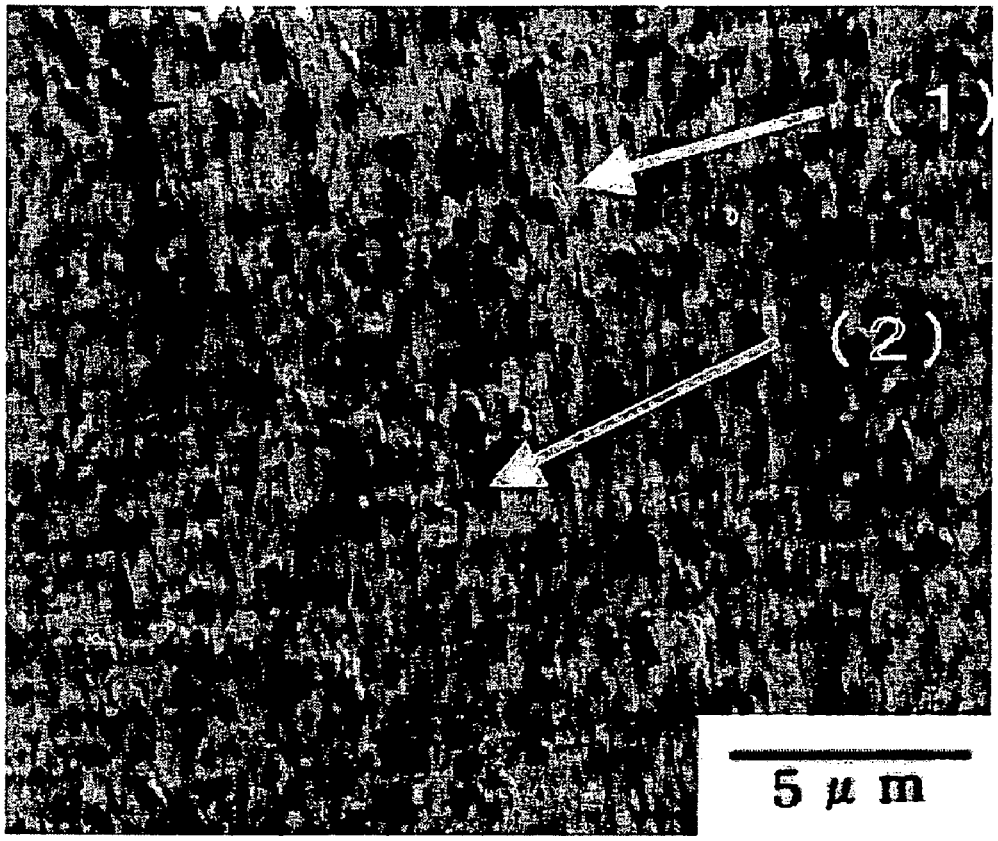
FIG. 3 is a scanning electron microscope picture of the binder resin for a toner used in Example 1.
Figure 4:
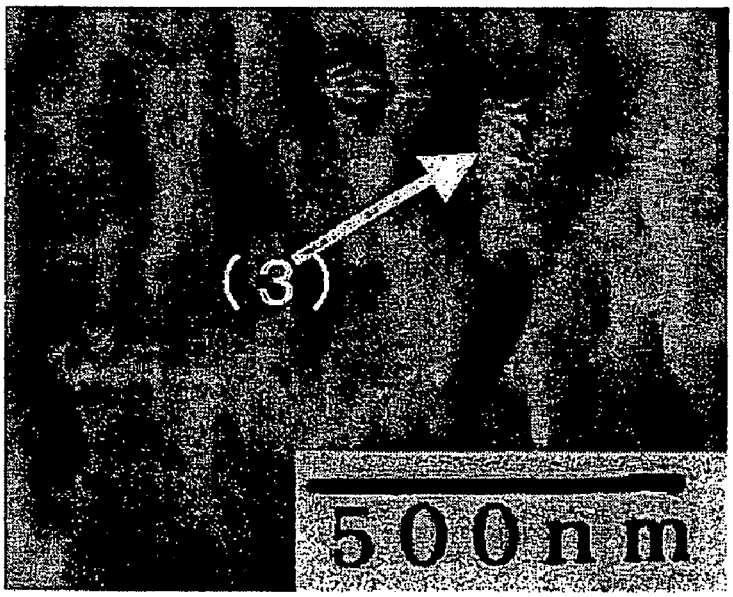
FIG. 4 is a scanning electron microscope picture of the binder resin for a toner used in Example 1.

Scanning electron microscope pictures of the binder resin for a toner used in Example 1 are shown in FIGS. 3 and 4. In the dyeing method used, the styrene acrylic resin is easily dyed, while the crystalline polyester resin is hardly dyed. The part (1) seen as white is the unreacted crystalline polyester resin, and a reactant of the crystalline polyester resin and the styrene acrylic resin. The part (2) seen as black is the unreacted styrene acrylic resin. From FIG. 3, it is found that (1) forms a network structure of a continuous phase, in which (2) exists as a discontinuous phase. Also, in FIG. 4, an enlarged view of FIG. 1, the white striped part (3) similar to fingerprints can be observed. These are lamella of the crystalline polyester resin. From this, it is found that the crystalline polyester is contained as a component forming a skeleton of the network structure. Here, it is found that a crystal of several μm is not observed, but minute crystals of several hundreds of nm are dispersed. Also, from the DSC measurement, an endothermic peak indicating the existence of a crystal component is observed. In Comparative Examples 1 to 5, the network structure of the present invention is not obtained.

Figure 5:
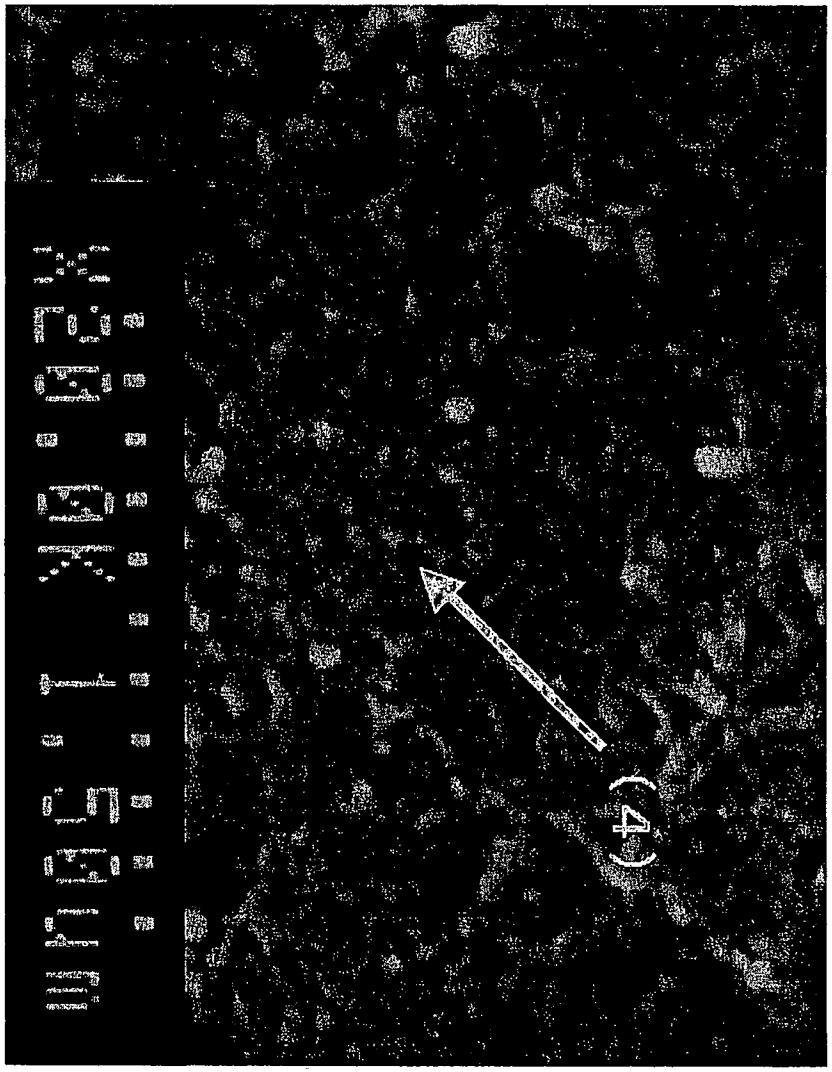
FIG. 5 is an electron microscope picture of the THF-insoluble portion extracted from the binder resin for a toner used in Example 1.

The scanning electron microscope picture of the THF-insoluble portion extracted from the binder resin for a toner used in Example 1 is shown in FIG. 5. 1 scale indicates 150 nm. The part (4) seen as black is a pore and a plurality of pores of not more than 200 nm can be observed. Typical pores are indicated by arrows in FIG. 5. The THF-insoluble portions of Comparative Examples 1 to 5 were observed via scanning electron microscope, but no pores as in (4) were observed.

Figure 6:
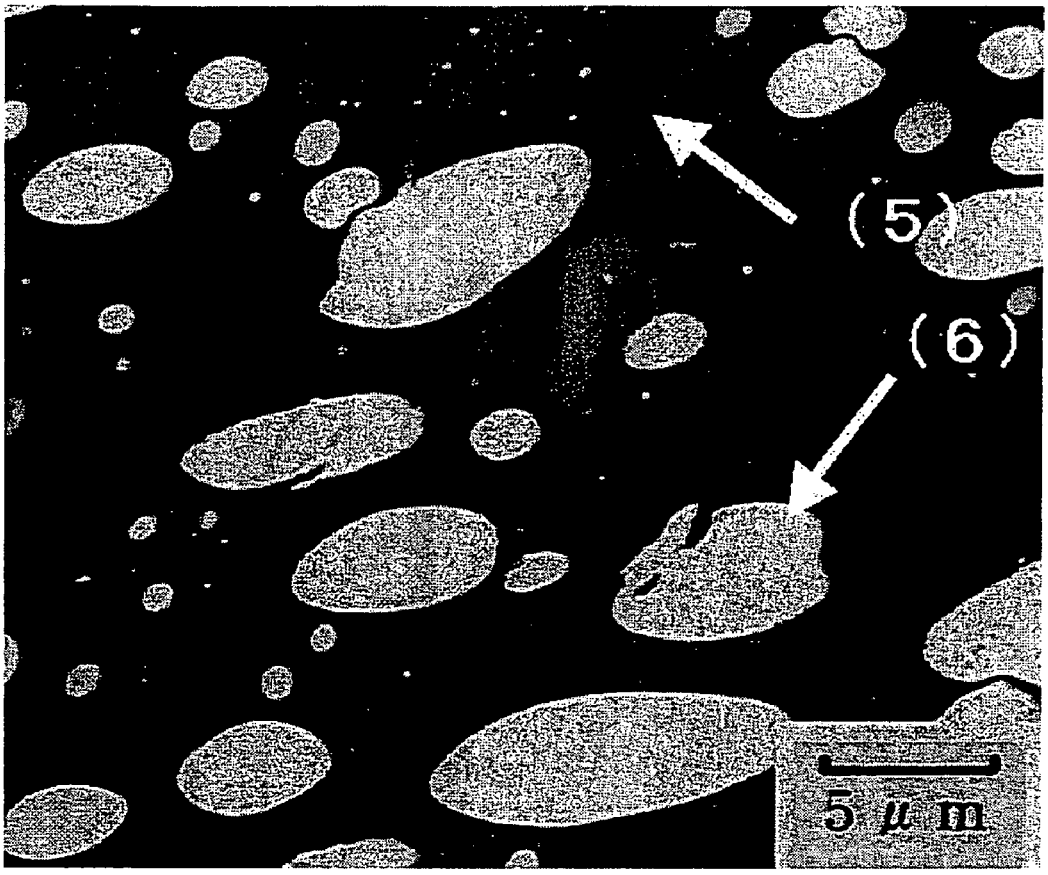
FIG. 6 is a scanning electron microscope picture of the binder resin for a toner used in Comparative Example 1.

The scanning electron microscope picture of the binder resin for a toner used in Comparative Example 1 is shown in FIG. 6. The part (5) seen as black is the styrene acrylic resin and the part (6) seen as white is the crystalline polyester resin. Here, it is found that, in the styrene acrylic resin, the crystalline polyester resin grows into a crystal of several μm, showing a non-homogeneous phase separated structure.

(Evaluation of Toner Performance)

The fixing property, offset resistance and storage stability were evaluated as shown below. The toners evaluated as AA or BB in all items were regarded as passing the evaluation.

(Fixing Property)

An unfixed image was formed using a copier produced by remodeling a commercial electrophotographic copier. Then, the unfixed image was fixed using a heat roller fixing apparatus produced by remodeling the fixing section of a commercial copier in order to control the temperature and fixing rate thereof at will. The fixing of a toner was conducted at a fixing rate of the heat roll of 190 mm/sec with the temperature of the heat roller being changed at intervals of 10° C. The fixed image obtained was rubbed 10 times by applying a load of 1.0 Kgf using a sand eraser (Tombow Pencil Co., Ltd., a plastic sand eraser "MONO"), and the image densities before and after the rubbing test were measured using a Macbeth reflection densitometer. The lowest fixing temperature, at which the change ratio of image density at each temperature became not less than 60%, was defined as the lowest fixing temperature of the toner and evaluated in accordance with the following standards. The heat roller fixing apparatus used had no silicon oil feeder. Namely, an offset preventing agent was not used. The environmental conditions were normal temperature and atmospheric pressure (temperature of 22° C. and relative humidity of 55%).

AA: Lowest fixing temperature of less than 120° C.

BB: 120≦lowest fixing temperature<150° C.

CC: Lowest fixing temperature of not less than 150° C.

(Offset Resistance)

The width of temperatures at which offset did not occur when copying (indicated as offset resistance temperature range) was evaluated in accordance with the following criteria. A series of results are shown in Table 5. The offset resistance was evaluated in compliance with the above measurement of the lowest fixing temperature. After an unfixed image was formed using the above copier, the toner image was transferred and fixed using the above heat roller fixing apparatus. Then, a white transfer paper was fed into the heat roller fixing apparatus under the same conditions, and the appearance of toner staining on the transfer paper was examined visually. This operation was repeated by gradually increasing the set temperature of the heat roller of the heat roller fixing apparatus. The lowest set temperature at which toner staining appeared on the transfer paper was defined as the temperature of hot offset appearance. Similarly, the test was carried out by gradually decreasing the set temperature of the heat roller of the heat roller fixing apparatus. The highest set temperature at which toner staining appeared on the transfer paper was defined as the temperature of cold offset appearance. The temperature difference between the hot offset temperature and cold offset temperature was defined as the offset resistance temperature range and evaluated in accordance with the following standards. Further, the environmental conditions were normal temperature and atmospheric pressure (temperature of 22° C. and relative humidity of 55%).

AA: Offset resistance temperature range of not less than 50° C.

BB: 30° C.≦Offset resistance temperature range<50° C.

CC: Offset resistance temperature range of less than 30° C.

(Storage Stability)

The toner was allowed to stand under an environment of 50° C. for 24 hours and then the degree of aggregation of the powder was visually determined as shown below. A series of results are shown in Table 5.

AA: No aggregation at all

BB: Slight aggregation

CC: Complete bulk state (Stability)

Chrominance of the toner was visually evaluated, whereby the quality of the toner particles was confirmed. The toner with a good pigment dispersability exhibited black luster, while bad toner was gray toner. A series of results are shown in Tables 5 and 6.

AA: Toner showing black luster

BB: Lusterless black toner

CC: Gray toner

TABLE 5

| | Heat of crystal melting of entire resin (J/g) | Crystal size (micro-meters) | Heat of crystal melting in THF-insoluble portion (J/g) | G' (Pa) | Relative peak intensity at 20 ms (%) | Relative peak intensity at 80 ms (%) | THF immersion types | Ratio of heat of crystal melting (THF-insoluble portion/ entire resin) |
|---|---|---|---|---|---|---|---|---|
| Example 1 | 15 | <0.5 | 43 | 110 | 23 | 6 | Swelling | 2.8 |
| Example 2 | 16 | 1 | 48 | 80 | 29 | 15 | Swelling | 3 |
| Example 3 | 9 | <0.5 | 23 | 120 | 18 | 3 | Swelling | 2.6 |
| Example 4 | 13 | <0.5 | 34 | 110 | 22 | 6 | Swelling | 2.6 |
| Comparative Example 1 | 25 | 5 | 110 | 6 | 42 | 29 | Partial sinking | 4.4 |
| Comparative Example 2 | 0 | — | 0 | 2800 | 4.5 | 0.9 | Dissolving | — |
| Comparative Example 3 | 0 | — | 0 | 5140 | 3.6 | 0.7 | Swelling | — |
| Comparative Example 4 | 36 | 1 | 108 | 60 | 76 | 44 | Partial sinking | 3 |
| Comparative Example 5 | 0 | — | 0 | 3 | 15 | 4 | Dissolving | — |

TABLE 6

| | | Fixing property | Offset resistance | Storage stability | Stability |
|---|---|---|---|---|---|
| Examples | 1 | AA | AA | BB | AA |
| | 2 | BB | AA | AA | BB |
| | 3 | BB | AA | AA | AA |
| | 4 | AA | AA | BB | AA |
| Comparative Examples | 1 | CC | CC | CC | CC |
| | 2 | CC | AA | AA | AA |
| | 3 | BB | AA | AA | AA |
| | 4 | AA | BB | CC | BB |
| | 5 | AA | CC | CC | AA |

The invention claimed is:

1. A method for producing a binder resin for a toner consisting of a tetrahydrofuran (THF) soluble portion and a THF-insoluble portion, wherein the entire resin in the bulk state is swollen when the resin in the bulk state is immersed in THF, said method comprising a step of subjecting an amorphous resin (X) having the amount of monomer having a carboxyl group of not less than 8 weight % based on the total amount of monomers and a peak molecular weight of not less than 20,000, an amorphous resin (Y) having the amount of monomer having a carboxyl group of less than 5 weight % based on the total amount of monomers and a peak molecular weight of less than 10,000, and a crystalline resin (Z) having a hydroxyl group to melting, kneading and reaction, wherein the amorphous resins and the crystalline resin are incompatible with each other.

2. A method for producing a binder resin for a toner satisfying all of the following requirements (1) to (3):

(1) the heat of crystal melting is not less than 5 J/g and the melting peak temperature is from 60 to 120° C., both being measured by DSC;

(2) the storage modulus (G') at 180° C. is not less than 100 Pa; and (3) in the pulsed NMR measurement using the Carr Purcel Meiboom Gill (CPMG) method, when the initial signal intensity of the free induction decay curve (FID) of $^{1}H$ nucleus to be obtained is defined as 100%, the relative signal intensity at 20 ms is not more than 30% and the relative signal intensity at 80 ms is not more than 20%, said method comprising a step of subjecting an amorphous resin (X) having the amount of monomer having a functional group of not less than 8 weight % based on the total amount of monomers and a peak molecular weight of not less than 20,000, an amorphous resin (Y) having the amount of monomer having a functional group of less than 5 weight % based on the total amount of monomers and a peak molecular weight of less than 10,000, and a crystalline resin (Z) to melting, kneading and reaction.

3. A method for producing a binder resin for a toner comprising a network structure which comprises a crystalline resin, said method comprising a step of subjecting an amorphous resin (X) having the amount of monomer having a functional group of not less than 8 weight % based on the total amount of monomers and a peak molecular weight of not less than 20,000, an amorphous resin (Y) having the amount of monomer having a functional group of less than 5 weight % based on the total amount of monomers and a peak molecular weight of less than 10,000, and a crystalline resin (Z) to melting, kneading and reaction.

* * * * *